US005098819A

United States Patent [19]

Knapp

[11] Patent Number: 5,098,819

[45] Date of Patent: Mar. 24, 1992

[54] NON-TOXIC PHOTOGRAPHIC DEVELOPER COMPOSITION

[76] Inventor: Audenried W. Knapp, 225 Larch Rd., Frankfort, Ill. 60423

[21] Appl. No.: 644,710

[22] Filed: Jan. 28, 1991

Related U.S. Application Data

[63] Continuation-in-part of Ser. No. 472,803, Jan. 31, 1990.

[51] Int. Cl.[5] ..... G03C 5/24

[52] U.S. Cl. ..... 430/436; 430/440; 430/441; 430/442; 430/446; 430/478; 430/480; 430/483; 430/490; 430/491

[58] Field of Search ..... 430/435, 436, 440, 441, 430/442, 446, 478, 480, 483, 491, 492

[56] References Cited

U.S. PATENT DOCUMENTS

| | | | |
|---|---|---|---|
| 2,685,515 | 8/1954 | Wilson | 430/465 |
| 2,688,549 | 9/1954 | James et al. | 430/480 |
| 3,295,975 | 1/1967 | Meckl et al. | 430/483 |
| 3,453,109 | 7/1969 | Lee et al. | 430/440 |
| 3,658,527 | 4/1972 | Kunz et al. | 430/234 |
| 3,887,375 | 6/1975 | Newman et al. | 430/479 |
| 4,495,277 | 1/1985 | Becker et al. | 430/567 |
| 4,639,416 | 1/1987 | Yoshida et al. | 430/567 |
| 4,753,869 | 6/1988 | Long et al. | 430/465 |
| 4,923,786 | 5/1990 | Kuhnert et al. | 430/465 |

*Primary Examiner*—Hoa Van Le

[57] ABSTRACT

An environmentally-safe, non-toxic non-hydroquinone and non-alkali metal hydroxide containing photographic developer composition is provided comprising a developer selected from the group consisting of ascorbic acid and sugar-type derivatives thereof, stereoisomers and diastereoisomers of ascorbic acid and its sugar-type derivatives, their salts and mixtures thereof, together with a sulfite, an alkali metal carbonate, and a 3-pyrazolidone developer compound.

32 Claims, No Drawings

NON-TOXIC PHOTOGRAPHIC DEVELOPER COMPOSITION

CROSS-REFERENCE TO RELATED APPLICATIONS

The present application is a continuation-in-part of U.S. patent application Ser. No. 07/472,803, filed Jan. 31, 1990.

BACKGROUND OF THE PRESENT INVENTION

The present invention is directed to an environmentally-safe, non-toxic photographic developer composition.

Photographic developer compositions are well-known in the art. The processing of silver halide photographic materials is performed by a multiple step sequence consisting of development, stopping, fixing and washing steps.

The development step is conventionally undertaken with an aqueous alkaline developer composition containing a developer such as hydroquinone and/or other well-known developing agents.

More specifically, the exposure of a silver halide emulsion to radiation to which the emulsion is sensitized produces a latent image in the silver halide grains of the emulsion. The latent image is developed by immersion of the exposed emulsion in an aqueous developing solution which contains a reducing agent (or developer). The hydroquinone or other suitable developer material serves to reduce the exposed silver halide grains to yield the developed photographic image.

Exemplary hydroquinone-based developer compositions are disclosed in, for example, U.S. Pat. Nos. 2,893,865; 3,733,199; 3,865,591; 4,046,571; 4,205,124; 4,756,990; and 4,816,384. Normally, these compositions contain relatively high levels of sulfite-based components.

It is also important to maintain the pH of the developer composition within strict alkaline ranges to ensure satisfactory operation of the composition. As a result, caustic alkalis (caustic soda or caustic potash) are frequently employed in the developer composition.

While hydroquinone-based developer compositions have been employed with success for many years, more recently the use of such compositions has met with some doubt due to the toxicity and environmental hazards posed by the use of the hydroquinone, sulfite and caustic alkali components. That is, due to the toxic nature of various of the components employed in conventional developer compositions, and the resultant high pH, it is necessary to meet various guidelines and regulations promulgated to protect either the health of those who are exposed to such compositions or to protect the environment into which such compositions are disposed. As two of the least desirable of the components generally present in conventional developer compositions are hydroquinone and related materials and caustic alkalis, it would thus be desirable to discover acceptable substitutes therefore which are less toxic by nature.

OBJECTS AND SUMMARY OF THE PRESENT INVENTION

It is thus one object of the present invention to provide a developer composition which does not require the presence of hydroquinone-type developer components.

It is also an object of the present invention to provide a developer composition which does not require the presence of large amounts of caustic alkali components such as alkali metal hydroxides to ensure the proper pH for the developer composition.

It is further an object of the present invention to provide a developer composition which is comprised of components which are substantially less toxic by nature and which may be safely disposed of without fear of contamination of the environment.

In accordance with the present invention, there is thus provided a non-hydroquinone and non-alkali metal hydroxide containing photographic developer composition comprising a developer selected from the group consisting of ascorbic acid and sugar-type derivatives thereof, stereoisomers and diastereoisomers of ascorbic acid and its sugar-type derivatives, their salts and mixtures thereof, together with a sulfite, an alkali metal carbonate, and a 3-pyrazolidone compound.

In accordance with the present invention, there is also provided a non-hydroquinone and non-alkali metal hydroxide containing photographic developer composition comprising a developer selected from the group consisting of (1) ascorbic acid or erythorbic acid, either singly or in admixture, together with at least one salt thereof, and (2) at least one salt of ascorbic or erythorbic acid, together with a sulfite, an alkali metal carbonate, and a 3-pyrazolidone developer compound.

In accordance with yet another embodiment of the present invention, there is provided a non-hydroquinone and non-alkali metal hydroxide containing photographic developer composition comprising a developer comprising erythorbic acid and at least one salt thereof together with a sulfite, an alkali metal carbonate, and a 3-pyrazolidone developer compound.

In accordance with yet another embodiment of the present invention, there is provided a non-hydroquinone and non-alkali metal hydroxide containing photographic developer composition comprising a developer comprising at least one salt of ascorbic or erythorbic acid together with a sulfite, an alkali metal carbonate, and a 3-pyrazolidone developer compound.

DETAILED DESCRIPTION OF THE PRESENT INVENTION

The present invention pertains to a non-hydroquinone containing photographic developer composition which requires neither a toxic hydroquinone-type developer nor a caustic alkali pH control agent. Instead, it has been found that such components can be replaced with success with substantially non-toxic components and the amounts of any toxic components which are present being reduced significantly.

Specifically, it has been found that in lieu of the toxic hydroquinone developers of the prior art, a developer may be employed selected from the group consisting of ascorbic acid and sugar-type derivatives thereof, stereoisomers and diastereoisomers of ascorbic acid and its sugar-type derivatives, their salts and mixtures thereof.

Such developers are discussed at length in U.S. Pat. Nos. 2,688,549 (James et al) and 3,942,985 (Newman et al), the substance of each patent being incorporated by reference in its entirety with regard to such discussion.

Suitable developers which fall within the scope of the above include but are not limited to ascorbic acid, d-erythro-ascorbic acid (i.e., erythorbic or isoascorbic acid), d-glucosascorbic acid, 6-deoxy-1-ascorbic acid, 1-rhamnoascorbic acid, 1-fucoascorbic acid, d-glucoheptoascorbic acid, sorboascorbic acid, ω-lactoascorbic acid, maltoascorbic acid, 1-araboascorbic acid, 1-glucoascorbic acid, d-galactoascorbic acid, 1-guloascorbic acid, and 1-alloascorbic acid.

Exemplary salts of such developers include alkali metal salts, such as the sodium and potassium salts thereof (e.g., sodium or potassium ascorbate and sodium or potassium erythorbate).

The unsubstituted compounds of this class of compounds may be represented by the formula:

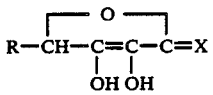

wherein X is an oxygen atom or imino group, R is any group which does not render the ascorbic acid water-insoluble and is a non-interfering group. Non-interfering is defined as not causing stearic hindrance, is not chemically reactive with other portions of the molecule, is not a coordinating group for the molecule, and is not more electropositive than a saturated hydrocarbon residue. R is preferably an aryl group or a group of the formula $R_1CH_2(CH)H)_{n-1}$— wherein n is a positive integer from 1 to 4 and $R_1$ is either a hydrogen atom or hydroxyl group when n is 2 to 4 and is hydroxyl when n is 1. Of these materials, ascorbic and erythorbic (isoascorbic) acid are preferred.

Representative developers identified above have the following structure:

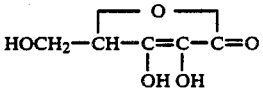

(1-erythro-ascorbic acid)

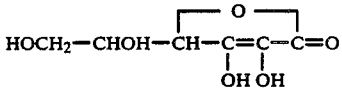

(1-ascorbic.acid)

As discussed above, it is known to employ ascorbic acid (or derivatives thereof) as a developer in photographic developer compositions as evidenced by U.S. Pat. Nos. 2,688,549 and 3,942,985.

U.S. Pat. No. 3,942,985 discloses a developer composition comprised of at least one of an iron chelate developer and ascorbic acid (or sugar-type derivative of ascorbic acid and stereoisomers and diastereoisomers of ascorbic acid and sugar-type derivatives thereof).

However, the prior art, while disclosing the use of ascorbic acid and certain of its derivatives in photographic developer compositions, fails to suggest a solution to the problem of providing a photographic developer composition which avoids use of both a hydroquinone developer and a pH control agent each of which exhibit certain toxic characteristics while at the same time enabling commercially acceptable development times to be achieved.

For instance, U.S. Pat. No. 3,942,985, while focusing upon the use of ascorbic acid and certain of its derivatives, still suggests the use of sodium hydroxide as a pH control agent. This patent also requires the use of an iron chelate developer.

U.S. Pat. No. 2,688,549 discloses a photographic developer composition which uses ascorbic acid and derivatives thereof as developing agents together with 3-pyrazolidone compounds in the absence of hydroquinone. However, the development times stated to be achieved are far in excess of the development times deemed to be desirable in the present commercial environment. For instance, the patent discloses that at development times of eight minutes image densities of 3.31–3.36 are achieved, with image densities of 1.79 being achieved with development times of two minutes.

However, it is desirable to provide a developer composition having the non-toxic properties discussed above which enables an image density of at least 4 to be achieved at a development time of from 10 to 200 seconds, and desirably less than 60 seconds.

U S. Pat. No. 3,022,168 (Stjarnkvist) discloses photographic developer compositions which employ ascorbic acid as a developer, with Examples 1, 2 and 4 disclosing a non-hydroquinone containing developer composition. The patent teaches that the optimum pH of the composition is 8.5–8.6, with an upper limit of 9 being taught.

However, the development times disclosed in the examples of this patent are also unsatisfactory. The patentee also employs the relatively toxic base potassium hydroxide in the developing compositions exemplified in the patent.

Despite such failures of the prior art, a developer composition which enables the desired advantages to be achieved (i.e., rapid development times in the absence of undesirable components) has been surprisingly and unexpectedly found which comprises ascorbic acid and sugar-type derivatives thereof, stereoisomers and diastereoisomers of ascorbic acid and its sugar-type derivatives, their salts and mixtures thereof, together with a sulfite, an alkali metal carbonate, and a 3-pyrazolidone compound, said composition having a pH of from 9.75 to 10.6, and the respective components being present in specified proportions and/or ratios as discussed hereinafter.

This composition may be successfully employed without need of a hydroquinone-type developer and without need of a caustic alkali as a pH control agent or large amounts of sulfite preservative. The composition enables an image density of at least 4 to be achieved at development times of 60 seconds or less.

The developer composition may contain a multitude of conventional additives which serve various functions such as additional developing agents, antifogging agents, buffers, sequestering agents, swelling control agents, development accelerators, etc.

For example, antifogging agents or restrainers (e.g., soluble halides such as sodium or potassium bromides and organic antifogging agents such as benzotriazole or phenylmercaptotetrazole) may be employed to retard the development of non-exposed silver halide and to decrease the occurrence of fog (i.e., the production of silver formed by development of non-exposed silver halide).

More specifically, exemplary organic antifogging agents include but are not limited to derivatives of benzimidazole, benzotriazole, tetrazole, imidazole, indazole, thiazole, and mercaptotetrazole used alone or in admixture.

Bromide ions are also desirably present to enhance stability. Sources of such ions may be potassium or sodium bromide.

Antioxidants such as alkali sulfites are generally present in a hydroquinone-type developer to limit oxidation of the developing agents. However, in the present invention the alkali sulfites that are normally employed in a ratio of 2 to 3 times the quantity of hydroquinone are desirably reduced to approximately 10% of the amount of ascorbic acid-based developer and serve primarily as a development enhancer.

Small amounts of sequestering agents (or chelating agents) are also generally employed to sequester trace metal ions (such as copper and iron ions) present in the water or chemicals used to produce the developer composition. Such trace metal ions serve to undesirably oxidize the developer component in the composition. Exemplary sequestering agents include but are not limited to aminopolycarboxylic acid compounds, ethylenediaminotetraacetic acid (EDTA) and sodium salts thereof, diethylenetriaminopentacetic acid (DTPA), diaminopropanoltetracetic acid (DPTA), etc. Suitable sequestering agents are known to those skilled in the art and need not be discussed in further detail.

The additional presence of a 3-pyrazolidone developing agent (or derivative thereof) results in a synergistic effect upon the speed of development of the developer composition. That is, such compounds enhance the rate by which image density is achieved over a given period of time at a specific temperature.

Among the 3-pyrazolidone developing agents which may be useful in the developer composition of the present invention are those of the formula:

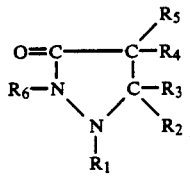

in which $R_1$ can be an alkyl group containing 1 to 12 carbon atoms, benzothiazolyl or an aryl group of the benzene or naphthalene series, substituted or not; $R_2$, $R_3$, $R_4$ and $R_5$ can be hydrogen, alkyl groups containing 1 to 12 carbon atoms, or aryl groups such as phenyl and napthyl, substituted or not; and $R_6$ can be hydrogen, an alkyl group, an acyl group or an aryl group; as well as salts thereof.

Typical 3-pyrazolidone compounds which may be employed include but are not limited to 4-(hydroxymethyl)-4-methyl-1-phenyl-3-pyrazolidone, 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, 1-p-chlorophenyl-3-pyrazolidone, 5-phenyl-3-pyrazolidone, 1-phenyl-5-methyl-3-pyrazolidone, 1-m-tolyl-3-pyrazolidone, 1-p-methoxyphenyl-3-pyrazolidone, etc. Additional representative examples of suitable 3-pyrazolidone compounds are disclosed in U.S. Pat. Nos. 2,688,549, 3,865,591 and 4,269,929, each herein incorporated by reference.

COMPARATIVE EXAMPLE A

The following is an example of a prior art developer composition which employs both hydroquinone and a caustic alkali pH control agent and which may successfully be replaced by the novel developer compositions of the present invention:

Sodium sulfite: 24.0 gms
Potassium metabisulfite: 13.2
$Na_4EDTA$: 0.6
4-(hydroxymethyl)-4-methyl-1-phenyl-3-pyrazolidone: 2.0
Benzotriazole: 0.09
1-phenyl-5-mercaptotetrazole: 0.008
Hydroquinone: 15.9
Potassium carbonate: 24.0
Sodium bromide: 2.7
Caustic potash: 18.3
Water to 1.0 liter A process control strip manufactured by 3M Company was exposed with a WEJEX sensitometer, manufactured by Tobias Associates, at the low intensity setting, employing a 21 step gray scale made by Stouffer Graphic Arts Co. This strip was processed for 35 seconds at 20° C. in the above developer composition at a pH of 10.65. The transmission density at step 2 was 4.12. The density in step 12 was 0.08.

COMPARATIVE EXAMPLE B

Example 1 of U.S. Pat. No. 2,688,549 was reproduced with the exception that Dimezones, a derivative of phenidone (1-phenyl-3-pyrazolidone), was used in combination with the ascorbic acid developer.

At the disclosed pH of 9, the development times realized by use of the exemplified developing composition were too slow for commercial value as demonstrated by the following data:

| | | Development Times | | |
|---|---|---|---|---|
| | | Run No. 1 (1 minute) | Run No. 2 (120 minutes) | control (22.5 secs) |
| Camera speed negative | dmin | 0.04 | 4.8 | 0.04 |
| | dmax | 0.74 | 4.9 | 5.5 |
| Camera speed positive | dmin | 0.05 | 2.06 | 0.04 |
| | dmax | 0.72 | 4.6 | 4.8 |

As demonstrated by the above data, after 120 minutes of processing, insignificant activity was noted in comparison to the activity realized in 22.5 seconds in a control developing composition which, by contrast, achieved full results in both speed and dmax. The composition of the present invention has been found to enable development results to be achieved comparable to those achieved by the above "control" developing composition.

EXAMPLE 1

The following is an example of a developer composition prepared according to the teachings of the present invention which desirably avoids the presence of hydroquinone or caustic alkali and is formulated for use in roller transport processors:

Sodium sulfite: 5.0 gms
$Na_4EDTA$: 0.6
1-phenyl-3-pyrazolidone: 2.0
Benzotriazole: 0.09
1-phenyl-5-mercaptotetrazole: 0.008
Sodium erythorbate: 31.5
Potassium carbonate: 24.0
Sodium bromide: 2.7
Water to 1.0 liter A strip exposed in the same manner as the Comparative Example that was processed in a developer composition containing hydroquinone, was processed for 35 seconds in the developer composition of Example 1 at 20° C. and at a pH of 10.41. The resultant image density in step 2 was 4.17. The density in step 12 was 0.11. These results are basically identical to those obtained from the strip processed in the hydroquinone-containing developer composition of Comparative Example A.

EXAMPLE 2

The following is an example of a developer composition prepared according to the teachings of the present invention which advantageously avoids the presence of hydroquinone or caustic alkali and is formulated for tray use:

Sodium sulfite: 12.5 gms
$Na_4EDTA$: 2.3
4-(hydroxymethyl)-4-methyl-1-phenyl-3-pyrazolidone: 1.04
Sodium erythorbate: 79.3
Potassium carbonate: 26.4
Sodium bromide: 10.0
Water to 1.0 liter

EXAMPLE 3

The following is an example of a developer composition prepared according to the teachings of the present invention which advantageously avoids the presence of hydroquinone or caustic alkali:

Sodium sulfite: 2.5 gms
Sodium metabisulfite: 1.9
$Na_4EDTA$: 0.6
4-(hydroxymethyl)-4-methyl-1-phenyl-3-pyrazolidone: 2.0
Benzotriazole: 0.09
1-phenyl-5-mercaptotetrazole: 0.008
Sodium erythorbate: 25.5
Erythorbic acid: 3.8
Potassium carbonate: 24.0
Sodium bromide: 2.7
Water to 1.0 liter The developer compositions of the present invention are also frequently prepared in the form of solid mixtures (powder form) of various components such as the developer, anti-fogging agent, sequestering agent, etc., with the developer composition converted to an aqueous form by the addition of the requisite amount of water in proportions consistent with the teachings of the present invention.

The composition of the present invention is alkaline by nature to permit its successful use as a developer. The pH of the developer composition in aqueous solution should be within the range of from about 9.75 to 10.6, and preferably within the range of from about 10.0 to 10.5. At pH's in excess of about 10.6, the developer composition is subject to degradation, while at pH's below about 9.75 the developer composition exhibits an undesirable reduction in activity.

The alkalinity of the composition may be maintained within the desired range by the presence of an alkali metal carbonate such as sodium or potassium carbonate. Sufficient carbonate should be present to ensure maintenance of the solution pH within the desired range.

An antioxidant such as sodium sulfite or sodium metabisulfite is also preferably present. Such sulfite compounds are normally employed in developer compositions as preservatives; however, such compounds serve the additional function of an accelerating compound in the present developer composition.

Exemplary sulfite compounds include those sulfur compounds capable of forming sulfite ions in aqueous solutions, such as alkali metal or ammonium sulfites, bisulfites, metabisulfites, sulfurous acid and carbonyl-bisulfite adducts. More specifically, such sulfite compounds include sodium sulfite, potassium sulfite, lithium sulfite, ammonium sulfite, sodium bisulfite, potassium metabisulfite, etc.

It has been determined that the amount of sulfite employed will generally be 10 to 20% of that normally employed in hydroquinone-containing developer compositions, which constitutes an additional advantage.

Obviously, the fact that the solution pH is significantly alkaline and an alkali metal carbonate is present results in any ascorbic acid developer (or related derivative thereof) which is present being transformed to the corresponding salt upon formation of or addition to an aqueous solution of the developer.

As a result, the developer composition of the present invention may, by way of example, be comprised (based on 1.0 liter of aqueous composition) of the above components within the following exemplary ranges:

| Component | Grams/liter | | |
|---|---|---|---|
| Akali sulfite | 2 | to | 20 |
| Sequestering agent (e.g., $Na_4EDTA$) | 1 | to | 3 |
| 3-pyrazolidone | 0.2 | to | 4 |
| Benzotriazole | 0.08 | to | 1 |
| 1-phenyl-5-mercaptotetrazole | 0.005 | to | 0.5 |
| Ascorbic acid-based developer | 15 | to | 80 |
| Alkali metal carbonate | 15 | to | 30 |
| Sodium bromide | 1 | to | 10 |

The above exemplary ranges for various specific compounds which may be employed with success in the developer composition of the present invention may vary somewhat taking into account differences such as molecular weight in related derivatives of such compounds (such as the use of calcium carbonate versus potassium carbonate). Such modifications of the above ranges is well within the ability of one skilled in the art.

With regard to the use of the developer composition of the present invention, the time and temperatures employed during the development step can vary widely. For instance, the development temperature can range from about 20° to 50° C. while the development time can vary from about 10 to 200 seconds.

After development, the silver halide material is fixed in a fixing composition, washed, and dried in a conventional manner.

What is claimed is:

1. A non-hydroquinone and non-alkali metal hydroxide containing photographic developer composition comprising a developer selected from the group consisting of ascorbic acid and sugar-type derivatives thereof, stereoisomers and diastereoisomers of ascorbic acid and its sugar-type derivatives, their salts and mixtures thereof, together with a sulfite, an alkali metal carbonate, and a 3-pyrazolidone compound, said composition having a pH of from 9.75 to 10.6, said developer being present in an amount of at least about 15 grams, said sulfite being present in an amount of from 2 to 20 grams, and said carbonate being present in an amount of from 15 to 30 grams, and water to 1.0 liter.

2. The developer composition of claim 1 wherein said developer is selected from the group consisting of ascorbic acid, erythroascorbic acid, 1-glucosascorbic acid, 1-rhamnoascorbic acid, 1-fucoascorbic acid, d-glucoheptoascorbic acid, sorboascorbic acid, ω-lactoascorbic acid, maltoascorbic acid, 1-araboascorbic acid, I-glucoascorbic acid, d-galactoascorbic acid, 1-guloascorbic acid, and 1-alloascorbic acid.

3. The developer composition of claim 1 wherein said developer comprises an alkaline metal salt.

4. The developer composition of claim 1 wherein said developer is selected from the group consisting of ascorbic and erythorbic acids and salts thereof.

5. The developer composition of claim 4 wherein said developer is selected from the group consisting of (1) ascorbic acid or erythorbic acid, either singly or in admixture, together with at least one salt thereof, and (2) at least one salt of ascorbic or erythorbic acid.

6. The photographic developer of claim 1 wherein said developer is potassium erythorbate.

7. The photographic developer of claim 1 wherein said developer is sodium erythorbate.

8. The photographic developer of claim 1 wherein said developer is a mixture of sodium erythorbate and erythorbic acid.

9. The photographic developer of claim 1 further comprising a component selected from the group consisting of a sequestering agent, an anti-fogging agent, and mixtures thereof.

10. The photographic developer of claim 1 wherein said sulfite is selected from the group consisting of sodium and potassium sulfite.

11. The photographic developer composition of claim 1 further comprising a sequestering agent.

12. The photographic developer composition of claim 11 wherein said sequestering agent comprises EDTA or a salt thereof.

13. The photographic developer composition of claim 1 wherein said 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chlorophenyl-3-pyrazolidone.

14. The photographic developer composition of claim 1 wherein said developer composition comprises 4-(hydroxymethyl)-4-methyl-1-phenyl-3-pyrazolidone, benzotriazole, 1-phenyl-5-mercaptotetrazole, potassium carbonate, and sodium bromide.

15. The photographic developer composition of claim 12 comprising $Na_4EDTA$.

16. The photographic developer composition of claim 1 wherein said developer has the formula

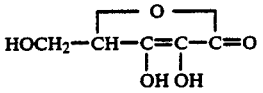

17. The photographic developer composition of claim wherein said developer has the formula

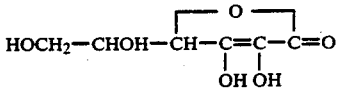

18. A method of effecting development of an imagewise exposed photographic material comprising effecting development of said material while in contact with a non-hydroquinone and non-alkali metal hydroxide containing aqueous development medium comprising a developer selected from the group consisting of ascorbic acid and sugar-type derivatives thereof, stereoisomers and diastereoisomers of ascorbic acid and its sugar-type derivatives, their salts and mixtures thereof, together with a sulfite, an alkali metal carbonate, and a 3-pyrazolidone compound, said composition having a pH of from 9.75 to 10 6, said developer being present in an amount of at least about 15 grams, said sulfite being present in an amount of from 2 to 20 grams, and said carbonate being present in an amount of from 15 to 30 grams, and water to 1.0 liter.

19. The method of claim 18 wherein said developer is selected from the group consisting of ascorbic acid, erythroascorbic acid, 1-glucosascorbic acid, 1-rhamnoascorbic acid, 1-fucoascorbic acid, d-glucoheptoascorbic acid, sorboascorbic acid, ω-lactoascorbic acid, maltoascorbic acid, 1-araboascorbic acid, 1-glucoascorbic acid, d-galactoascorbic acid, 1-guloascorbic acid, and 1-alloascorbic acid.

20. The method of claim 18 wherein said developer comprises an alkaline metal salt.

21. The method of claim 18 wherein said developer is selected from the group consisting of ascorbic and erythorbic acids and salts thereof.

22. The method of claim 21 wherein said developer is selected from the group consisting of (1) ascorbic acid or erythorbic acid, either singly or in admixture, together with at least one salt thereof, and (2) at least one salt of ascorbic or erythorbic acid.

23. The method of claim 18 wherein said developer is potassium erythorbate.

24. The method of claim 18 wherein said developer is sodium erythorbate.

25. The method of claim 18 wherein said developer is a mixture of sodium erythorbate and erythorbic acid.

26. The method of claim 18 further comprising a component selected from the group consisting of a sequestering agent, an anti-fogging agent, and mixtures thereof.

27. The method of claim 18 wherein said sulfite is selected from the group consisting of sodium and potassium sulfite.

28. The method of claim 18 further comprising a sequestering agent.

29. The method of claim 28 wherein said sequestering agent comprises EDTA or a salt thereof.

30. The method of claim 18 wherein said 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chlorophenyl-3-pyrazolidone.

31. The method of claim 18 wherein said developer composition comprises 4-(hydroxymethyl)-4-methyl-1-phenyl-3-pyrazolidone, benzotriazole, 1-phenyl-5-mercaptotetrazole, potassium carbonate, and sodium bromide.

32. The method of claim 29 comprising $Na_4EDTA$.

* * * * *

UNITED STATES PATENT AND TRADEMARK OFFICE

CERTIFICATE OF CORRECTION

PATENT NO. : 5,098,819

DATED : March 24, 1992

INVENTOR(S) : Audenried W. Knapp

It is certified that error appears in the above-identified patent and that said Letters Patent is hereby corrected as shown below:

Column 3, line 33 delete --"(l-erythro-ascorbic acid)"--

On the Title Page "32 claims" should read --31 claims--.

Column 9, line 68, after "claim" insert --1--.

Delete Claim 16.

Signed and Sealed this

Fifth Day of October, 1993

Bruce Lehman

*Attest:*

BRUCE LEHMAN

*Attesting Officer*

*Commissioner of Patents and Trademarks*